US007263734B1

(12) United States Patent
Buchanan et al.

(10) Patent No.: US 7,263,734 B1
(45) Date of Patent: Sep. 4, 2007

(54) MAGNETICALLY RETAINED CPR DUMP

(75) Inventors: Richard W. Buchanan, Hamburg, NY (US); Mark Landgraf, West Seneca, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 0 days.

(21) Appl. No.: 11/600,257

(22) Filed: Nov. 15, 2006

(51) Int. Cl.
*A47C 27/10* (2006.01)
*A47C 27/08* (2006.01)

(52) U.S. Cl. ..... 5/713; 5/706

(58) Field of Classification Search ..... 5/713–715, 5/706–712, 644, 654, 655.3, 615, 689
See application file for complete search history.

(56) References Cited

U.S. PATENT DOCUMENTS 4,914,760 A * 4/1990 Hargest et al. ..... 5/689
4,942,635 A * 7/1990 Hargest et al. ..... 5/689
4,949,414 A * 8/1990 Thomas et al. ..... 5/713
4,967,431 A * 11/1990 Hargest et al. ..... 5/689
5,029,352 A * 7/1991 Hargest et al. ..... 5/689
5,036,559 A * 8/1991 Hargest ..... 5/689
5,052,067 A * 10/1991 Thomas et al. ..... 5/713
5,062,167 A * 11/1991 Thomas et al. ..... 5/614
5,065,466 A * 11/1991 Thomas et al. ..... 5/713
5,073,999 A * 12/1991 Thomas et al. ..... 5/615
5,095,568 A * 3/1992 Thomas et al. ..... 5/713
5,105,487 A * 4/1992 Hakamiun et al. ..... 5/689
5,121,513 A * 6/1992 Thomas et al. ..... 5/713
5,168,591 A * 12/1992 Hakamiun et al. ..... 5/689
5,182,826 A * 2/1993 Thomas et al. ..... 5/713
5,243,723 A * 9/1993 Cotner et al. ..... 5/710
5,251,349 A * 10/1993 Thomas et al. ..... 5/713
5,542,136 A 8/1996 Tappel
5,560,057 A * 10/1996 Madsen et al. ..... 5/715
5,606,754 A * 3/1997 Hand et al. ..... 5/713
5,647,079 A * 7/1997 Hakamiun et al. ..... 5/713
5,794,289 A * 8/1998 Wortman et al. ..... 5/713
6,061,855 A 5/2000 Flick
6,098,222 A * 8/2000 Hand et al. ..... 5/713
6,119,292 A * 9/2000 Haas ..... 5/715
6,415,814 B1 * 7/2002 Hand et al. ..... 137/487.5
6,591,437 B1 * 7/2003 Phillips ..... 5/713
6,721,980 B1 * 4/2004 Price et al. ..... 5/713
6,813,790 B2 * 11/2004 Flick et al. ..... 5/713
6,820,640 B2 * 11/2004 Hand et al. ..... 137/487.5
6,829,796 B2 * 12/2004 Salvatini et al. ..... 5/713

(Continued)

*Primary Examiner*—Robert G. Santos
(74) *Attorney, Agent, or Firm*—Roach Brown McCarthy & Gruber, P.C.; Kevin D. McCarthy

(57) ABSTRACT

The present invention involves a patient support system. The support system has a fluid bladder and a container. The container has an air pump, a manifold and a CPR dump system. The CPR dump system has a manifold aperture, a plug positioned in the manifold's aperture, a rod interconnected to the plug and protruding from the container's opening, a magnetized alignment apparatus, and a magnetized stop mechanism. The magnetized stop mechanism fastens to the rod and magnetically attaches to the magnetized alignment apparatus which insures the plug is lodged in the manifold's aperture. When a user wants to expeditiously deflate the inflatable fluid bladder, the user pulls on the distal end with sufficient force to detach the magnetized stop mechanism from the magnetized alignment apparatus thereby the plug dislodges from the manifold aperture and allows the inflatable fluid bladder to deflate within a predetermined time frame.

20 Claims, 3 Drawing Sheets

U.S. PATENT DOCUMENTS

| | | | | |
|---|---|---|---|---|
| 6,907,633 | B2 * | 6/2005 | Paolini et al. | 5/713 |
| 6,943,694 | B1 * | 9/2005 | Ellis | 340/666 |
| 7,155,766 | B1 * | 1/2007 | Gilchrest et al. | 5/732 |
| 2003/0061664 | A1 * | 4/2003 | Salvatini et al. | 5/713 |
| 2003/0208848 | A1 * | 11/2003 | Flick et al. | 5/713 |
| 2003/0213067 | A1 * | 11/2003 | Paolini et al. | 5/713 |
| 2004/0194220 | A1 * | 10/2004 | Price et al. | 5/713 |
| 2005/0091753 | A1 * | 5/2005 | Salvatini et al. | 5/713 |
| 2006/0101581 | A1 * | 5/2006 | Blanchard et al. | 5/713 |
| 2006/0282955 | A1 * | 12/2006 | Gilchrest et al. | 5/732 |
| 2007/0101504 | A1 * | 5/2007 | Gilchrest et al | 5/706 |

* cited by examiner

MAGNETICALLY RETAINED CPR DUMP

FIELD OF THE INVENTION

The present invention relates to a mattress system having an inflatable bladder that can deflate within a prescribed time frame when a CPR dump protocol is initiated.

BACKGROUND OF THE INVENTION

A CPR dump protocol is when a medical provider determines a patient positioned on an inflatable bladder which is positioned over a support surface needs to bottom out to the support surface. Bottom out means the patient contacts the support surface. It is an objective in the CPR dump protocol for the inflatable bladder to be completely deflated of any air, but realistically, the inflatable bladder contains some residual air and that residual air does not prevent the patient from contacting at least a portion of the support surface.

There are numerous types of mattresses containing inflatable bladders. Some of those mattresses contain an inflatable bladder arrangement with a number of separate zones, and a control unit that separately controls the pressure in each zone. Such a mattress is described in U.S. Pat. No. 5,542,136. While mattresses of this type have been generally adequate for their intended purposes, they have not been satisfactory in all respects.

At least where there is a plurality of zones, the mattress unit is often an integral part of an entire bed. Since the mattress is the entire bed and has various bladders, the mattress unit normally deflates slowly. In some instances, the mattress unit must deflate in seconds, not minutes. Such rapid deflation is necessary when the patient requires emergency care, such as, cardiopulmonary resuscitation (CPR). This rapid deflation is commonly called a CPR dump protocol.

A conventional CPR dump, as described in U.S. Pat. No. 5,542,136, entails pushing a CPR button. That CPR button causes the control unit to deflate the bladders. That control unit opens all the valves and reverses the direction of the blower so the blower sucks air out of the bladders. The "sucked air" enters a manifold. That manifold directs the "sucked air" into a conduit that expels the "sucked air" from the mattress unit.

Obviously, that CPR dump system, of U.S. Pat. No. 5,542,136, has numerous mechanical operations that must operate properly to deflate the numerous bladders. If one of those mechanical operations (the electrical connection between the CPR button and the other electrical instruments, i.e., the blower and valves, the blower must timely switch its direction and speed, the valves must switch, the manifold must be capable of directing all the "sucked air" into the single conduit, and the single conduit must be large enough to direct the "sucked air" out of the manifold) does not properly or timely operate then the CPR dump system essentially malfunctions. Such malfunctions are extremely deleterious to the patient and should be avoided.

Gaymar Industries, Inc. proposed an alternative CPR dump system in U.S. Pat. No. 6,061,855. In that patent, Gaymar wrote, "The system includes a mattress unit, inflatable bladder means, an air control unit, a manifold plate and a quick release plate. The mattress unit has therein the inflatable bladder means, has operational and collapsed states in which the bladder means is respectively inflated and deflated, has an exterior surface which includes an upwardly facing top portion in the operational state, and has at one end a foot section. In the foot section, the mattress unit also has a portion of the bladder means and has means defining in the foot section below the portion of the bladder means the air control unit within the mattress unit. The air control unit has a manifold plate that interconnects the inflation means to the bladder means. The manifold plate has a set of female receptacles open to the exterior surface of the mattress unit. The quick release plate has a set of male connectors that correspond to the female receptacles. Each male connector has a slidable variance, permitting it to be removably received from the corresponding female receptacle. Thus, when any pulling force from any direction is applied to the quick release plate, the quick release plate disengages from the manifold plate resulting in the bladder means deflating within a predetermined time frame." That CPR dump system is applicable if a quick release plate can be used in association with a manifold. That is not always possible due to size constraints.

It is therefore an object of the present invention to provide an inflatable mattress system that has a CPR dump system that decreases any possible malfunctions and able to be used in confined areas.

A further object of the invention is to provide a mattress system wherein a person with limited training can perform the CPR dump protocol safely and effectively in a prescribed time frame.

SUMMARY OF THE INVENTION

The objects and purposes of the invention, including those set forth above, are met according to the present invention. The present invention involves a patient support system. The support system has a fluid bladder and a container. The fluid bladder is positioned within a patient support unit. The container has an air pump, a manifold and a CPR dump system. The air pump unit directs air toward the fluid bladder. The manifold is positioned between the air pump unit and the fluid bladder, and has valves that control the amount of air that enters a conduit that directs the air into the fluid bladder. The CPR dump system has an aperture in the manifold, a plug designed to be positioned in the manifold's aperture, a rod having a proximal end interconnected to the plug and a distal end protruding from an opening in the container, a magnetized alignment apparatus positioned between the manifold and the container's opening while supporting a portion of the rod, and a magnetized stop mechanism. The magnetized stop mechanism is fastened to the rod between the magnetized alignment apparatus and the container's opening and magnetically attached to the magnetized alignment apparatus which insures the plug is lodged in the manifold's aperture. When a user wants to expeditiously deflate the inflatable fluid bladder, the user pulls on the rod's distal end with sufficient force to detach the magnetized stop mechanism from the magnetized alignment apparatus which causes the plug to dislodge from the manifold aperture and allows the inflatable fluid bladder to deflate within a predetermined time frame.

BRIEF DESCRIPTION OF THE DRAWINGS

A preferred embodiment of the present invention is described in detail hereinafter with reference to the accompanying drawings, in which.

DETAILED DESCRIPTION OF THE PRESENT INVENTION

Figure 1:
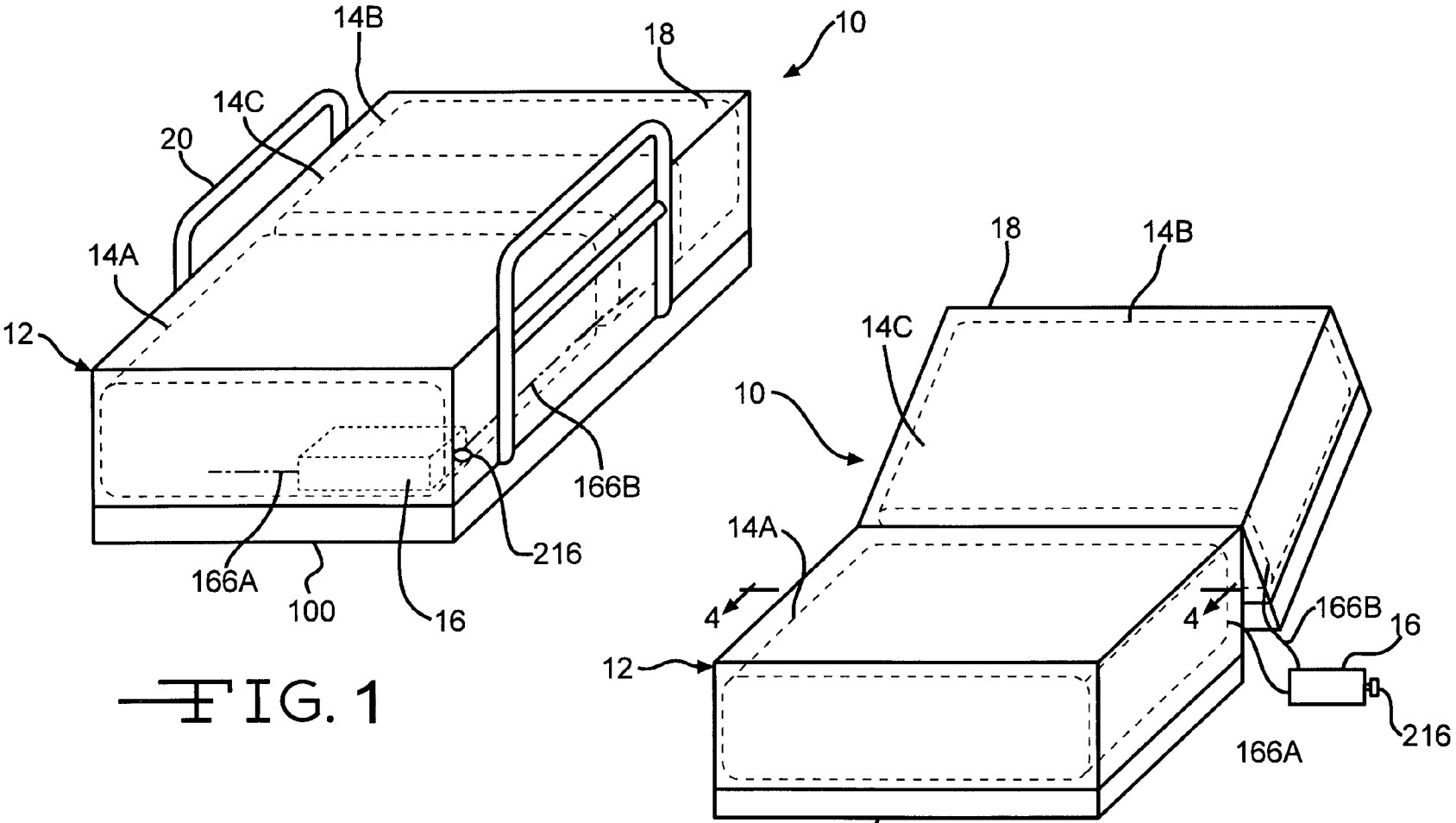
FIG. 1 illustrates a first embodiment of the present invention.
Figure 2:
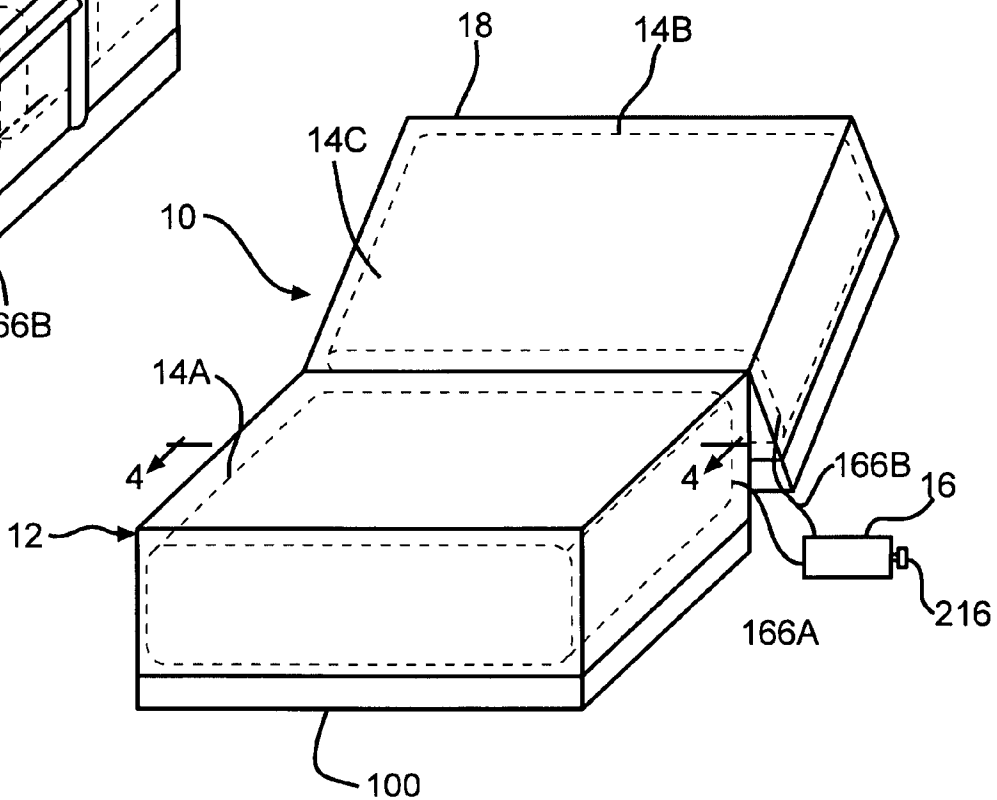
FIG. 2 illustrates a second embodiment of the present invention.

FIGS. 1 and 2 illustrate a mattress system 10 having a mattress 12 positioned over a support surface 100. The support surface 100 can have the mattress (a) remain in a supine position as illustrated in FIG. 1, and/or (b) undergo a gatching process as illustrated in FIG. 2. The gatching process occurs when the support surface 100 is able to position the mattress 12 (1) from a supine position to (i) an inclined position and possibly (ii) a cardiac chair position, (2) at positions in between the cardiac chair position and the supine position and (3) vice versa.

Figure 3:
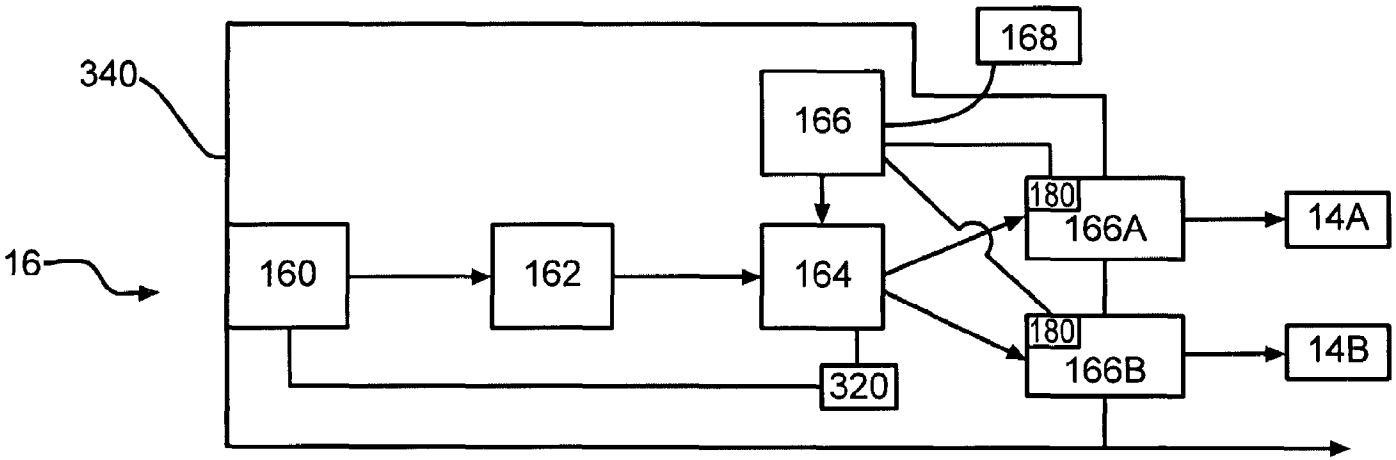
FIG. 3 illustrates a schematic of the present invention.

The mattress 12 contains a fluid cushion 14 (illustrated in broken lines in FIGS. 1 and 2 and for purposes of this discussion receives air). The air cushion 14 is filled with air to a desired air pressure and/or size through an air pump system 16. The air pump system 16, as schematically illustrated at FIG. 3, comprises an air pump 160 that directs, in this embodiment, ambient air toward a main conduit 162. The main conduit 162 directs the air to a manifold system 164 (which includes valves and the like). The manifold system 164, controlled by a processor 166 and/or manually, directs the air to a branch conduit 166 (or conduits 166*a,b*) that further directs the air into a bladder 14*a* or set of bladders 14*b,c*. The processor 166 can be programmed with a conventional input apparatus 168 that can be directly (shown) or indirectly interconnected to the processor. The manifold system 164 through its valves controls the amount of air that enters (and exits when the air pump is not activated or operating in reverse) the inflatable bladder 14.

The air pump system 16 is positioned within the mattress 12 as illustrated in FIG. 1 or exterior to the mattress 12 as illustrated in FIG. 2. The pressure within the air cushion 14 can be monitored by an air pressure sensor 180 positioned within (a) the fluid cushion 14, (b) a branch conduit 166*a*, 166*b* that connects the air pump system 16 to the fluid cushion 14, (c) the air pump 160 and/or (d) combinations thereof. The pressure sensor 180 transmits a measurement signal to the processor. In response to the measurement signal, the processor 166 maintains or alters the aperture size (including closing) of the valves in the manifold system 164 so the correct amount of air enters the fluid bladders 14. The size of the air cushion 14 can also be monitored by (a) the quantity of light in the air cushion, (b) the distance between two position sensors within the cushion, and (c) equivalents thereof. The methods in which the air cushion 14 is filled to a particular air pressure and/or size are known to those of ordinary skill in the art.

Figure 4:
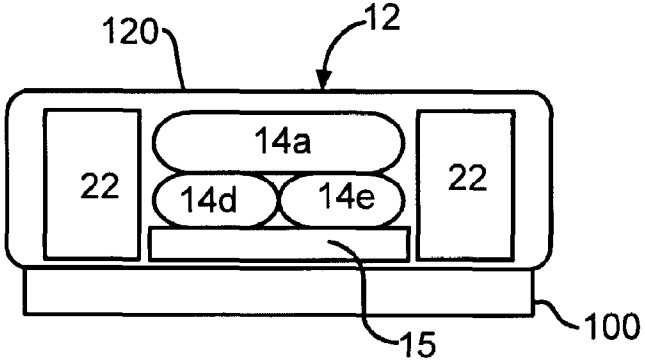
FIG. 4 illustrates a cross-sectional view of an alternative embodiment of FIG. 2 taken along lines 4-4.

Whatever the mattress 12 configurations, the air cushion 14 is at least partially enclosed by a cover material 18. It is also understood that additional air and/or fluid cushions 14*d* and *e* may be incorporated in the mattress 12 to provide rotation capabilities, vibration capabilities, turn-assist capabilities, percussion capabilities, and/or any other therapeutic characteristics as illustrated in FIG. 4. If the cushion 14*a* and/or the additional cushions 14 *b-e* are limited to receiving air, then those air cushions can provide low-air loss capabilities—small apertures in the cushions that blow air toward the patient positioned on the mattress' 12 top surface 120. It is also understood that other bedding materials can be positioned above, on the side of (item 22 for position only), and/or below (item 15 for position only) the cushions 14 to obtain desired results. An example of other bedding materials includes gelastic type materials, down, springs, and/or foam-like materials.

The mattress system 10 also normally has guard rails 20 (FIG. 1) and/or a crib 22 (FIG. 4) to decrease the chances that the patient falls off the mattress system 10. The crib 22 is normally a foam-like material and/or inflated bladder positioned about the perimeter of the cushion 14. In many instances, the crib 22 and/or the guard rail 20 prevents a patient from falling off the bed.

Figure 5:
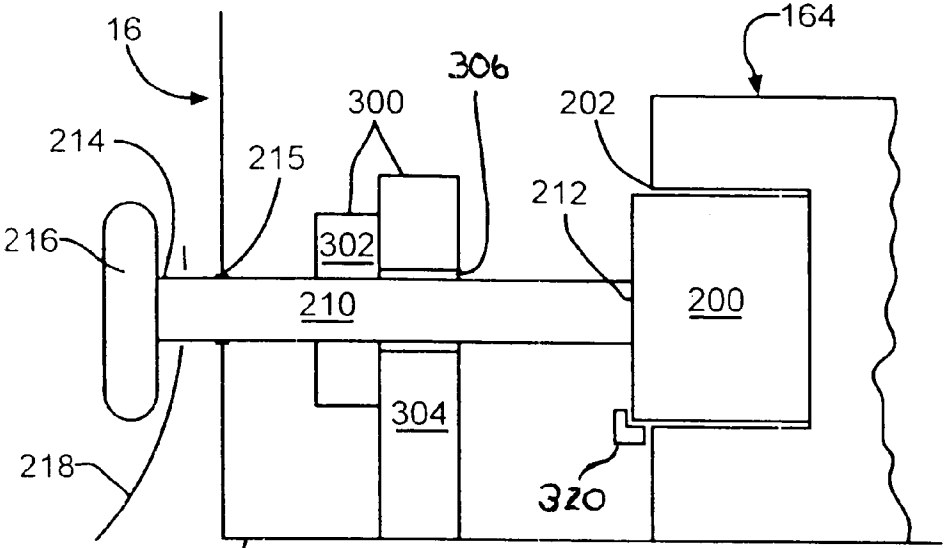
FIG. 5 illustrates a cross-sectional view of a portion of the air pump system illustrated in FIGS. 1 and 2 and only in relation to the CPR dump system used in the air pump system and how connected to the manifold.

The present invention, however, concentrates on CPR dump plugs 200. The CPR dump plugs 200 are male components that slide into corresponding female apertures 202 of the manifold system 164. When the CPR dump plugs 200 are securely positioned within the female apertures 202 (a.k.a., lodged) as illustrated in FIG. 5, the CPR dump plugs 200 allow the manifold system 164 to operate as described above. In contrast, when the CPR dump plugs 200 are not sealingly positioned within the female apertures 202 (a.k.a., dislodged), the CPR dump plugs initiate a sequence of events that result in the bladders 14 being deflated at an expedited rate—the CPR dump protocol.

A first embodiment of the CPR dump protocol is that the air pump 160 ceases pushing air toward the fluid bladders 14 which allows the patient (and the medical provider), by gravity, to push the air (or at least the majority of the air) out of the bladders 14. That way the patient is bottomed out so CPR or other medical procedures can be properly administrated to the patient.

Another CPR dump protocol is that the air pump 160 initiates drawing the air out of the fluid bladders and simultaneously the patient (and the medical provider), by gravity, pushes the air (or the majority of air) out of the bladders 14. Again the patient is expeditiously bottomed out so the patient can be properly administered CPR.

A problem with these embodiments is dislodging the CPR plug 200 from the female receptacle 202 of the manifold system 164 without opening a container 340 that normally encloses the air pump system 16. To accomplish this objective, the present invention interconnects the CPR plugs 200 to a rod 210. The rod 210 has a proximal end 212 and a distal end 214. The proximal end 212 connects to the CPR plugs 200 and the distal end 214 extends beyond the perimeter of the container 340 through a first aperture 215 as illustrated in FIG. 5. The distal end 214 can be interconnected to a handle 216. The handle 216 provides easy access for the medical provider to initiate dislodging the CPR plugs from the female receptacles 202 of the manifold system 164 without opening the container 340.

In addition, a strap 218 can be positioned on the rod 210 and positioned between the handle 216 and the perimeter of the air pump system container 340 to provide additional easy access for the medical provider to initiate dislodging the CPR plugs from the female receptacles 202 of the manifold system 164 without opening the container 340.

Dislodging the CPR plugs is not an ordinary event and should only occur when necessary. To decrease the chance of accidental or unnecessary dislodging, the present invention utilizes a secure mechanism 300.

In one embodiment the secure mechanism 300 has a magnetized stopper 302 securely attached to a portion of the rod 210 and a magnetized stop barrier 304 with a second aperture 306. The second aperture 306 allows the rod 210 to slide back and forth with little difficulty. The magnetized stopper 302 is positioned between the magnetized stop barrier 304 and the first aperture 215 of the perimeter of the air pump system container 16. The magnetized stop barrier 304 is positioned so that when the magnetized stopper 302 is positioned against (and magnetically attached to) the magnetized stop barrier 304 the plug 200 is securely inserted (lodged) into the female aperture 202. The magnetized stopper 302 and the magnetized stop barrier 304 do not have to be completely magnetized. Instead the magnetized stopper 302 and the magnetized stop barrier 304 have to each have a portion of their structure that is magnetized and those magnetized portions have to contact each other. When the plug 200 is securely inserted (lodged) into the female aperture 202 the magnetized portions of the magnetized stopper 302 and the magnetized stop barrier 304 are attached to each other and the CPR dump protocol of deflating the bladders 14 at an expedited rate is not initiated.

Initiating the CPR dump protocol of deflating the bladders 14 at an expedited rate occurs when a medical provider pulls the handle 216 (and/or strap 218) away from the air pump system container 16 with a force greater than the magnetic force between the magnetized stopper 302 and the magnetized stop barrier 304. When the magnetized stopper 302 and the magnetized stop barrier 304 are separated, the plugs 200 are dislodged from the manifold's aperture 202 which initiates the CPR dump protocol. An advantage that this mechanism has over the previous "press and click" CPR dump mechanisms is that the CPR engagement/disengagement with the magnetized forces is much easier and more positive for the caregiver, eliminating the possibility of having a partially seated CPR dump plug in the manifold.

A position sensor 320 can be positioned to indicate whether the CPR plug 200 is securely engaged (lodged) with the female aperture 202, and/or the CPR dump protocol has been activated. That sensor 320 can be positioned adjacent to the plug 200/female aperture 202 juncture, the magnetized stopper 302/magnetized stop barrier 304 juncture or any other position along and/or adjacent to the rod 210. The sensor 320 transmits a signal when it detects that the CPR protocol has been initiated when the plug is dislodged from a portion of the manifold's aperture. The signal is sent to (a) the air pump 160 to either shut it off, or alternatively to reverse the air flow from the pump 160 and/or (b) the manifold 164 to open all valves to allow the air to escape from the bladders 14 (14*a, b, c, d, e*). The sensor can be a microswitch, a Hall effect, a magnetic proximity switch, a giant magneto-restrictive device or any alternative switch apparatus that can transmit a signal to the air pump 160 and/or the manifold 164 to proceed with the CPR dump protocol.

Alternative Embodiment

Figure 6:
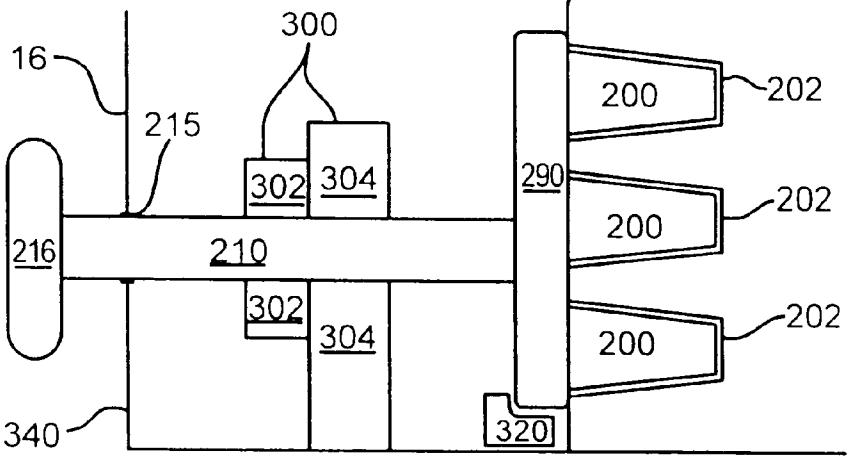
FIG. 6 illustrates an alternative embodiment of FIG. 5.

The present invention can have the proximal end 212 of the rod 210 attached to a second manifold 290 that contains numerous plugs 200 that are inserted into corresponding female apertures 202 of the manifold 164. See FIG. 6. That way, numerous plugs 200 can be used in the present invention.

Although a particular preferred embodiment of the invention has been illustrated and described in detail for illustrative purposes, it will be recognized that variations or modifications of the disclosed apparatus, including the rearrangement of parts, lie within the scope of the invention defined by the claims. The embodiments of the invention in which an exclusive property or privilege is claimed are defined as follows:

We claim:

1. A patient support system comprising:

an inflatable fluid bladder positioned within a patient support unit;

an air pump unit that directs air toward the fluid bladder, a container having (A) a manifold (i) positioned between the air pump unit and the fluid bladder, and (ii) having valves that control the amount of air that enters a conduit that directs the air into the fluid bladder; and (B) a CPR dump system having (i) an aperture in the manifold, (ii) a plug designed to be positioned in the manifold's aperture, (iii) a rod having a proximal end interconnected to the plug and a distal end protruding from an opening in the container, (iv) a magnetized alignment apparatus positioned between the manifold and the container's opening while supporting a portion of the rod, and (v) a magnetized stop mechanism (a) fastened to the rod between the magnetized alignment apparatus and the container's opening and (b) magnetically attached to the magnetized alignment apparatus which insures the plug is lodged in the manifold's aperture;

wherein when a user wants to expeditiously deflate the inflatable fluid bladder, the user pulls on the rod's distal end with sufficient force to detach the magnetized stop mechanism from the magnetized alignment apparatus which causes the plug to dislodge from the manifold aperture and allows the inflatable fluid bladder to deflate within a predetermined time frame.

2. The patient support system of claim 1 wherein the container is positioned within the patient support system.

3. The patient support system of claim 1 wherein the container is positioned exterior to the patient support system.

4. The patient support system of claim 1 wherein a sensor is positioned to determine if the plug is dislodged from the manifold's aperture.

5. The patient support system of claim 4 wherein the sensor transmits a signal to the air pump unit to shut down the air pump unit when the plug is dislodged from the manifold's aperture so the inflatable fluid bladder can deflate within a predetermined time frame.

6. The patient support system of claim 4 wherein the sensor transmits a signal to the manifold to open the valves when the plug is dislodged from the manifold's aperture so the inflatable fluid bladder can deflate within a predetermined time frame.

7. The patient support system of claim 4 wherein the sensor transmits a signal to the air pump unit to reverse the air pump unit's air flow when the plug is dislodged from the manifold's aperture so the inflatable fluid bladder can deflate within a predetermined time frame.

8. The patient support system of claim 4 wherein the sensor is selected from the group consisting of a microswitch, a Hall effect, a magnetic proximity switch, and a giant magneto-restrictive device.

9. The patient support system of claim 1 further comprising a processor interconnected to the manifold to control the valve opening.

10. The patient support system of claim 1 further comprising a processor interconnected to the air pump unit to control when the air pump unit operates.

11. The patient support system of claim 1 wherein the magnetized alignment apparatus has a hole that receives the rod.

12. The patient support system of claim 1 wherein the rod is not magnetized.

13. The patient support system of claim 1 wherein the rod's proximal end is directly connected to the plug.

14. The patient support system of claim 1 wherein the plug connects to a manifold plate and the rod's proximal end connects to the manifold plate.

15. The patient support system of claim 14 wherein the manifold plate is interconnected to a second plug and the second plug is lodged in a second aperture of the manifold when the magnetized stop mechanism is magnetically attached to the magnetized alignment apparatus.

16. The patient support system of claim 1 further comprising a handle at the rod's distal end.

17. The patient support system of claim 1 further comprising a strap positioned between the handle and the container's aperture.

18. The patient support system of claim 1 wherein the magnetized stop mechanism and the magnetized alignment apparatus are partially magnetized.

19. The patient support system of claim 1 wherein the patient support unit is a mattress.

20. A method to perform CPR comprising:

finding a patient in need of CPR positioned on a patient support unit having a fluid bladder positioned within the patient support unit;

an air pump unit that directs air toward the fluid bladder, a container having (A) a manifold (i) positioned between the air pump unit and the fluid bladder, and (ii) having valves that control the amount of air that enters a conduit that directs the air into the fluid bladder; and (B) a CPR dump system having (i) an aperture in the manifold, (ii) a plug designed to be positioned in the manifold's aperture, (iii) a rod having a proximal end interconnected to the plug and a distal end protruding from an opening in the container, (iv) a magnetized alignment apparatus positioned between the manifold and the container's opening while supporting a portion of the rod, and (v) a magnetized stop mechanism (a) fastened to the rod between the magnetized alignment apparatus and the container's opening and (b) magnetically attached to the magnetized alignment apparatus which insures the plug is lodged in the manifold's aperture;

pulling the rod's distal end with sufficient force to detach the magnetized stop mechanism from the magnetized alignment apparatus so the plug dislodges from the manifold aperture and allows the inflatable fluid bladder to deflate within a predetermined time frame.

* * * * *